United States Patent [19]

DeCota

[11] 4,023,811

[45] May 17, 1977

[54] GOLF SWING TRAINING DEVICE

[76] Inventor: Louis F. DeCota, 7 Old Mill Lane, Randolph, Mass. 02368

[22] Filed: May 19, 1976

[21] Appl. No.: 687,658

[52] U.S. Cl. ..... 273/186 R; 273/191 A

[51] Int. Cl.[2] ..... A63B 69/36

[58] Field of Search ..... 273/186 R, 186 C, 191 R, 273/192, 204, 183 A, 109, 110, 191 A, 191 B

[56] References Cited

UNITED STATES PATENTS

| | | | |
|---|---|---|---|
| 2,084,902 | 6/1937 | Eisenberg | 273/192 |
| 3,868,116 | 2/1975 | Ford et al. | 273/186 C |
| 3,870,315 | 3/1975 | Lawlor et al. | 273/186 R |

*Primary Examiner*—George J. Marlo

*Attorney, Agent, or Firm*—Dike, Bronstein, Roberts, Cushman & Pfund

[57] ABSTRACT

A device to aid golfers in perfecting their golf swing during putting, chipping, driving and other usual golf situations. It provides a swing track comprising a pair of parallel spaced rails, rotatably mounted to a bracket, so as to be offset from the base surface. This track defines the preferred swing trajectory in the vicinity of ball contact. Faulty swings outside of such trajectory will touch one of the rails, imparting motion to the track. This rotation of the track both indicates the faulty swing and suggests the correction needed.

7 Claims, 4 Drawing Figures

GOLF SWING TRAINING DEVICE

BACKGROUND OF THE INVENTION

1. Introduction

This invention relates to golf swing practice devices and particularly to a swing track which defines the preferred club head trajectory in the vicinity of ball contact and provides visible indicia of both a faulty swing and the correction needed to acquire the desired flight path of the ball.

2. Description of the Prior Art

One of the main causes for high scores in the game of golf is the failure of the club face to strike the ball squarely; i.e., perpendicular to the intended line of flight of the ball. Such perpendicular attitude is determined to a large extent by the path followed by the club head in backstroke, downswing, and follow-through. In this regard, it is well-known that every person has a natural rhythm, more or less developed in the sense of coordination of body movements, and that such movements are carried out naturally at an individually characteristic tempo. Physical educators, albeit recognizing this individual rhythm, know that one's muscles can be effectively trained through repeated practice to adduce an automatic control of function. Such muscular training when directed toward a proper golf swing provides a "grooved" swing which is automatic.

Realizing the importance of such proper muscle training in effectng continued proper gulf club trajectory during swing, numerous attempts have been made to provide devices to attain this training goal. These training devices typically are characterized by two distinct designs.

The first of these, exemplified by U.S. Pat. Nos. 1,532,984; 3,107,920; 3,113,780; 3,408,076; and 3,550,946 and British Patent Specification No. 137,444 employ movable flags, pins, and wands to indicate club head trajectory. However, these movable indicia of a faulty swing, being restricted by their very design to specific points in the swing, do not encompass the entire swing path in the vicinity of contact. This lack of total coverage precludes the detection of all areas of incorrect trajectory. Further, such devices fail to provide both a visual and physical track for grooved swing muscle training.

The second series of swing practice devices, exemplified by U.S. Pat. Nos. 3,194,565; 3,572,720; 3,586,335 and 3,870,315; and British Pat. Specification No. 187,396, remedying the above disadvantages employ a pair of flexible strips or sensors. These members embrace the proper swing path in the vicinity of ball contact and provide through contact therewith a physical indicia of a faulty swing. However, such contact, particularly during high club speed practice swings, generates unfavorable arm and shoulder stress due to impact with the substantially non-movable tracks.

SUMMARY OF THE INVENTION

Accordingly, it is an object of the present invention to provide a golf swing track characterized by movably encompassing the entire swing path in the vicinity of ball contact. Such track visually and physically trains a golfer to conform his swing to the preferred trajectory but through free displacement yields to misdirected swings without hand, arm and shoulder stress and shock.

It is a further object of the invention to train muscular response during a golf swing with a track of simple, inexpensive yet durable construction such that these muscles automatically foster a grooved swing during an actual round of golf.

It is still another object of this invention to provide a golf swing track which is useful to left or right-handed and tall or short golfers in their golf swing practice with woods, irons and putter.

DESCRIPTION OF THE PREFERRED EMBODIMENTS

Figure 1:
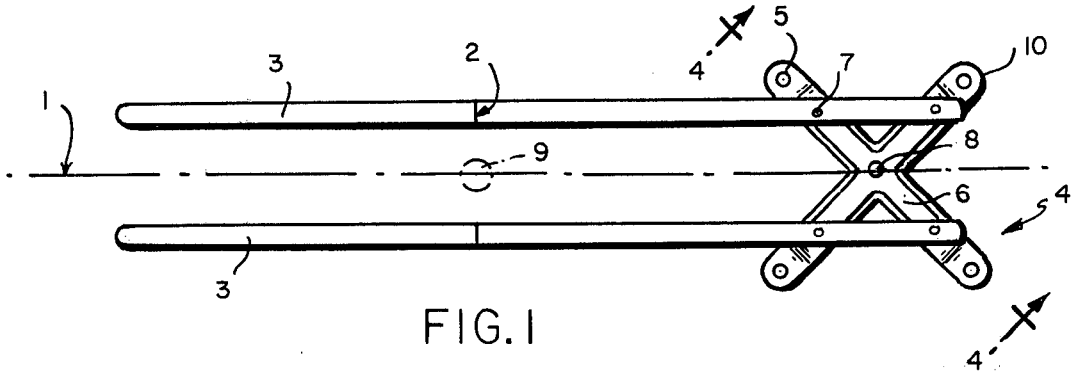
FIG. 1 is a plan view of the swing track of this invention in the normal position.

Referring now to the drawings in detail, there is shown in FIG. 1 a swing track in accordance with this invention in the normal position, i.e., located with respect to desired line of ball flight 1 so as to adduce preferred club head trajectory. This swing track comprises a pair of rails 3, such rails including an indicating means 2 for defining lengthwise actual or imaginary ball placement 9. These rails are held in constant (about 5 inches) parallel relationship to each other by two crossed bracket means 6, one end of each of the brackets being securely fastened to the same rail through connecting means 7. Moreover, the intersection point of the crossed brackets is connected to a base 4 through a shouldered fastening means 8 so as to permit easy rotation about such cross point. Base 4, in the embodiment depicted, comprises two crossed pedestals 10, formed so as to afford free rail rotation and held together at the intersection point by the non-shouldered portion of fastening means 8. Further, such base pedestals include near their extremities feet means 5 enabling both securing of the base to the stationary surface, the ground or floor respectively, and variably offsetting the base from such surface so, as to specifically locate the rails at that height corresponding to the imaginary or actual ball 9. Thus, for example, during tee shot practice such height would be greater than that required during putting practice. Additionally, the base member may include stopping means (not shown) to prevent complete rotation of the rails on club contact.

Prior to use, the swing track, in accordance with this invention, requires the preliminary vertical, lengthwise and lateral placement of the ball real or imaginary, within the swing track. While for purpose of illustration this discussion is directed to ball placement, the swing track could of course be placed relative to the ball using similar steps. As noted previously the lengthwise ball position relative to the swing track is defined by rail indicators 2. However, the lateral position of the ball between the rails 3 along this defined locus is determined by the physical characteristics of the golfer, the size of the club being used and the specific location of the center of its ball-striking face. Such determination is made by placing the appropriate club face along the line of the rail indicators such that the swing will be directed away from the bracket and base and locating the toe of such club about ¼ inch from the rail. The ball, real or imaginary, is then positioned at the center of the striking portion of this face. The vertical position of the ball being determined by the shot attempted, i.e., tee shot to putt, the height of the top of the rails may be adjusted to conform to the ball's verticle placement through appropriate manipulation of the offset portion of the feet means.

Figure 2:
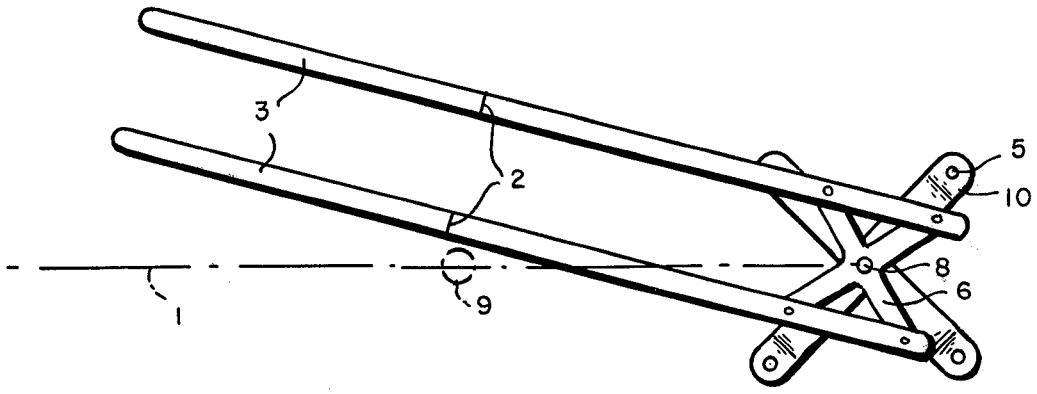
FIG. 2 is a plan view of the swing track of this invention in displaced position.

Having correctly positioned the ball relative to the swing track, the golfer takes a stance at the proper stance position with his feet and body in proper position with reference to the ball position (and therefore properly located with reference to the training device). The golfer will the initially draw the club head back in the space defined by the swing track, attempting to avoid contact with either rail so as to achieve a preferred backswing. On downswing and follow-through, the golfer will again attempt to avoid contact with either rail. Should the swing be faulty, contact will be made between the club head and the rail, this contact displacing the swing track so as to avoid hand, arm and shoulder stress and to indicate the incorrect path of the swing. Thus, contact with the outer (remote) rail will result in a displacement depicted in FIG. 2 and will show the golfer that the swing was outside the line of flight and hence diverging from it on the far side. Such contact might indicate that he is doing any of the following: throwing the club from the top with his hand; taking the club back inside; rotating his shoulders on too horizontal a plane; not taking the club back in one piece; or spinning his hips.

Conversely, contact with the inner (near) rail and inward rail movement will serve as indicia that he is pulling the club inside the line of flight, throwing the club at the bottom of the swing with the top hand, taking the club back inside, blocking hip movement or moving head and body past the ball.

By correcting these faults, through adjusting the swing path to that defined by the tracks, the golfer will achieve proper club head trajectory in the vicinity of ball contact. Such corrective practice will train muscular response during a swing and make the grooved swing an automatic reflex with or without swing track guidance.

Figure 3:
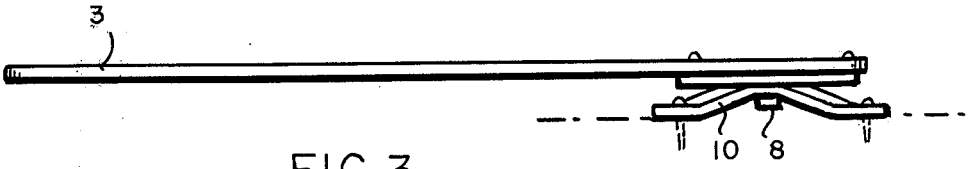
FIG. 3 is a side view of the swing track of this invention.
Figure 4:
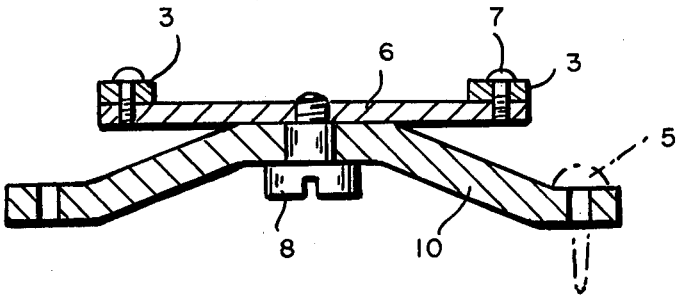
FIG. 4 is an end view of the swing track of this invention.

FIGS. 3 and 4 depict other views of the swing track of this invention.

While the specific materials and construction of the rails, bracket means, base, assorted fastening members and feet means are not critical, being limited only by the accomplishment of their respective function, some perferences are to be noted.

The rails, balancing durability with avoidance of club head damage, are preferably wood, such as oak, impact resistant plastic or metal covered with a resilient surface coating. The bracket means ad base while preferably metal, e.g., steel, may be plastic or wooden in construction. The fastening members and feet means are preferably metal or plastic.

Although the invention is not limited to the dimensions of the various parts, for purposes of illustration and to assist in the construction of same, a satisfactory embodiment has been produced having ¾ × 1¼× 48 inches oak rails held parallel 5 inches from each other by crossed ⅛ inch steel brackets, bolted to about the last 6 inches of the rails by ¼ inch bolts. The base of ⅛ inch steel, includes steel feet to offset the height of the rails and secure the base to the stationary surface. It is connected to the brackets by a ⅜ inch shouldered center bolt to insure facile rotation of the rails and brackets about the base.

It will be obvious to one skilled in the art that various changes may be made in the invention without departing from the spirit and scope thereof and therefore, the invention is not limited by that which is illustrated in the drawings and described in the specification, but only as indicated in the accompanying claims.

We claim:

1. A golf swing practic device comprising a pair of rails a pair of crossed bracket means, securely connected to said rails near one end thereof by connecting means to maintain said rails spaced laterally apart in a constant parallel relationship and allow the head of a golf club to be swung therebetween; and a base, connected to said crossed bracket means at the intersection point thereof by a shouldered fastening means so as to promote free rotation of said rails about said base and including near the extremities of said base feet means, enabling the connection of said base to a stationary surface and the offset of said base from said surface.

2. The device of claim 1 wherein said rails are spaced about 5 inches apart.

3. The device of claim 2 wherein said rails are oak.

4. The device of claim 1 wherein said base comprises a pair of crossed pedestals.

5. The device claim 4 wherein said crossed pedestal means includes stopping means to preclude complete rotation of said rails.

6. The device claim 5 wherein said crossed bracket means and said crossed pedestals are steel.

7. The device of claim 5 wherein said fastening means, said feet means and said shouldered fastening means are metal.

* * * * *